US005647324A

United States Patent [19]

Nakajima

[11] Patent Number: 5,647,324

[45] Date of Patent: Jul. 15, 1997

[54] ENGINE AIR-FUEL RATIO CONTROLLER

[75] Inventor: Yuki Nakajima, Yokosuka, Japan

[73] Assignee: Nissan Motor Co., Ltd., Yokohama, Japan

[21] Appl. No.: 648,969

[22] Filed: May 17, 1996

[30] Foreign Application Priority Data

May 18, 1995 [JP] Japan ..... 7-120026

[51] Int. Cl.[6] ..... F02D 41/06; F02D 41/10; F02D 41/12

[52] U.S. Cl. ..... 123/491; 123/492; 123/493

[58] Field of Search ..... 123/480, 491, 123/492, 493

[56] References Cited

U.S. PATENT DOCUMENTS

| | | | |
|---|---|---|---|
| 4,357,923 | 11/1982 | Hideg | 123/492 |
| 5,353,768 | 10/1994 | Messih et al. | 123/491 |
| 5,494,019 | 2/1996 | Ogawa | 123/480 |
| 5,542,393 | 8/1996 | Katoh et al. | 123/491 |

FOREIGN PATENT DOCUMENTS

| | | |
|---|---|---|
| 1-305142 | 12/1989 | Japan . |
| 3-134237 | 6/1991 | Japan . |

*Primary Examiner*—Tony M. Argenbright

*Attorney, Agent, or Firm*—Foley & Lardner

[57] ABSTRACT

This invention relates to a wall flow correction of an engine having a fuel injector that injects fuel towards a fuel adhesion part such as an air intake valve. An equilibrium adhesion mount of fuel adhering to a fuel adhering part and a quantity proportion are computed based on a cooling water temperature in a temperature equilibrium state. The adhesion amount of fuel adhering to the fuel adhering part is also predicted at the present time, and the temperature of the fuel adhering part is estimated. A temperature difference between a detected cooling water temperature and estimated fuel adhering part temperature is computed, and an adhesion rate is calculated based on this equilibrium adhesion amount, quantity proportion, predicted adhesion amount and temperature difference. A basic injection amount is corrected using this adhesion rate, and the precision of air-fuel ratio control immediately after start-up when the temperature of the fuel adhering part is in a non-equilibrium state, is improved.

11 Claims, 13 Drawing Sheets

ENGINE AIR-FUEL RATIO CONTROLLER

FIELD OF THE INVENTION

This invention relates to an engine air-fuel ratio controller, and more specifically, to a transient correction of a fuel injection amount during engine start-up.

BACKGROUND OF THE INVENTION

In air-fuel ratio control of a fuel mixture supplied to an engine, deviation of an air-fuel ratio during engine acceleration/deceleration from a target value is often related to so-called wall flow of fuel. Wall flow refers to a phenomenon wherein, for example, fuel injected from a fuel injection nozzle adheres to an engine intake valve or intake port, and flows down walls into a cylinder as a liquid. Due to the fact that the flowrate of this wall flow varies depending on the acceleration/deceleration of the engine, the air-fuel ratio of the fuel mixture also varies.

In air-fuel ratio control, the fuel supply amount is usually corrected by considering oversupply or undersupply of fuel due to wall flow as a transient correction amount.

For example, an equilibrium adhesion mount Mfh and quantity proportion Kmf are first determined according to an engine load, engine speed Ne and cooling water temperature Tw, and an adhesion rate Vmf is found from a mathematical expression using these values.

The equilibrium adhesion amount Mfh is a fuel adhesion amount in a steady state determined by the engine speed and temperature of a fuel adhering part. The quantity proportion Kmf is a factor indicating the extent to which a difference (Mfh-Mf) between the equilibrium adhesion amount Mfh and an adhesion amount Mf at present can be reflected in a correction of fuel injection amount. The adhesion rate Vmf is an adhesion amount per unit fuel injection period (per unit injection), and a basic fuel injection amount Tp is corrected by this adhesion rate Vmf.

However, in the case of an engine where the fuel injection nozzle injects fuel towards the intake valve, a large error appears in the air-fuel ratio when the equilibria adhesion amount Mfh and quantity proportion Kmf are computed from the cooling water temperature Tw, and this is especially true immediately after a cold start. In this case, the wall flow fuel amount is affected by the temperature of the intake valve on the surface of which the wall flow is flowing, and the temperature difference between the valve temperature and cooling water temperature Tw leads to an error in the estimate of wall flow.

In this context, Tokkai Hei 1-305142 published by the Japanese Patent Office in 1989 discloses a method wherein the valve temperature is first estimated, and the valve temperature is used instead of the cooling water temperature Tw for computing Mfh and Kmf. Immediately after start-up, the valve temperature is effectively the same as the cooling water temperature Tw, and it levels off to a temperature that is higher than Tw by a constant value (e.g. approx. 80° C.). Also, the variation of the valve temperature is a first order delay depending on a time constant determined by the engine air intake volume. A predicted valve temperature Tf can therefore be found from the following equation:

$$Tf=Th\cdot SPTF+Tf_{-1}\cdot(1-SPTF) \quad (1)$$

wherein, $Tf_{-1}$ is the value of Tf on the immediately preceding occasion.

An equilibrium intake valve temperature Th and delay time constant SPTF are first determined using the engine load and speed as parameters.

In Tokkai Hei 3-134237 published by the Japanese Patent Office in 1991, a wall flow correction temperature Twf which converges toward the cooling water temperature Tw with a first order delay, is used instead of the cooling water temperature Tw.

According to the aforesaid embodiment, the data used for calculating Mfh and Kmf correspond to the case where the valve temperature has levelled off to the temperature which is higher by a predetermined amount, i.e. to an equilibrium temperature state, when the cooling water temperature Tw is constant. Consequently, in a non-equilibrium temperature state, Mfh and Kmf found using this data contain an appreciable error. As a result, a transient correction amount of a non-equilibrium temperature state may still contain an appreciable error, since calculations are performed based on Mfh, Kmf which have large errors even when a non-equilibrium temperature state is simulated using the wall flow correction temperature Twf instead of the cooling water temperature Tw.

More specifically, in the aforesaid methods, the equilibrium temperature state wherein Twf=40° C. (cooling water temperature Tw=40° C.) and the non-equilibrium temperature state wherein Twf=40° C. (cooling water temperature Tw is not 40° C.) are considered as being the same. This tends to cause errors in the a-fuel ratio immediately after start-up when non-equilibrium temperature conditions prevail continuously.

SUMMARY OF THE INVENTION

It is therefore an object of this invention to improve the precision of air-fuel ratio control immediately after the engine start-up when the intake valve temperature or wall flow correction temperature is in a non-equilibrium state.

In order to achieve the above object, this invention provides a fuel injection controller for an engine in which fuel is injected towards a fuel adhering part from a fuel injector. The controller comprises a mechanism for computing a basic fuel injection amount, a mechanism for detecting an engine cooling water temperature, a mechanism for computing an equilibrium amount of the injected fuel adhering to the fuel adhering part based on a cooling water temperature in an equilibrium state, a mechanism for computing a quantity proportion based on the cooling water temperature in the equilibrium state, a mechanism for predicting an amount of injected fuel that will adhere to the fuel adhering part at a present time, a mechanism for estimating a temperature of the fuel adhering part, a mechanism for computing a temperature difference between the cooling water temperature and the temperature of the fuel adhering part, a mechanism for computing an adhesion rate based on the equilibrium adhesion amount, the predicted adhesion amount, the quantity proportion and the temperature difference, a mechanism for correcting the basic injection amount and computing a fuel injection amount based on the adhesion rate, and a mechanism for supplying the fuel injection amount to the fuel injector.

According to an aspect of this invention, the adhesion rate computing mechanism comprises a mechanism for correcting the equilibrium adhesion amount according to the temperature difference, and a mechanism for computing an adhesion rate by multiplying a difference between a corrected equilibrium adhesion amount and the predicted adhesion amount, by the quantity proportion.

In this case, it is preferable that the equilibrium adhesion amount correcting mechanism further corrects the equilibrium adhesion amount according to any one of the cooling water temperature, the fuel adhering part estimated temperature and the cooling water temperature during engine start-up.

It is also preferable that the equilibrium adhesion amount correcting mechanism further corrects the equilibrium adhesion amount according to an engine load.

According to another aspect of this invention, the adhesion rate computing mechanism comprises a mechanism for correcting the quantity proportion according to the temperature difference, and a mechanism for calculating an adhesion rate by multiplying a difference between the equilibrium adhesion amount and the predicted adhesion amount, by a corrected quantity proportion.

In this case, it is preferable that the quantity proportion correcting mechanism further corrects the quantity proportion according to any one of the cooling water temperature, the fuel adhering part estimated temperature and the cooling water temperature during engine start-up.

It is also preferable that the quantity proportion correcting mechanism further corrects the quantity proportion according to an engine load.

According to yet another aspect of this invention, the adhesion rate computing mechanism comprises a mechanism for calculating an adhesion rate by multiplying a difference between the equilibrium adhesion amount and the predicted adhesion amount by the quantity proportion, and a mechanism for correcting the adhesion rate according to the temperature difference.

In this case, it is preferable that the adhesion rate correcting mechanism further corrects the quantity proportion according to any one of the cooling water temperature, the fuel adhering part estimated temperature and the cooling water temperature during engine start-up.

It is also preferable that the adhesion rate correction mechanism further corrects the adhesion rate according to an engine load.

According to yet another aspect of this invention, the adhesion amount prediction mechanism updates the predicted adhesion amount on every fuel injection by adding the adhesion rate to the predicted adhesion amount.

The details as well as other features and advantages of this invention are set forth in the remainder of the specification and are shown in the accompanying drawings.

DESCRIPTION OF THE PREFERRED EMBODIMENTS

Figure 1:
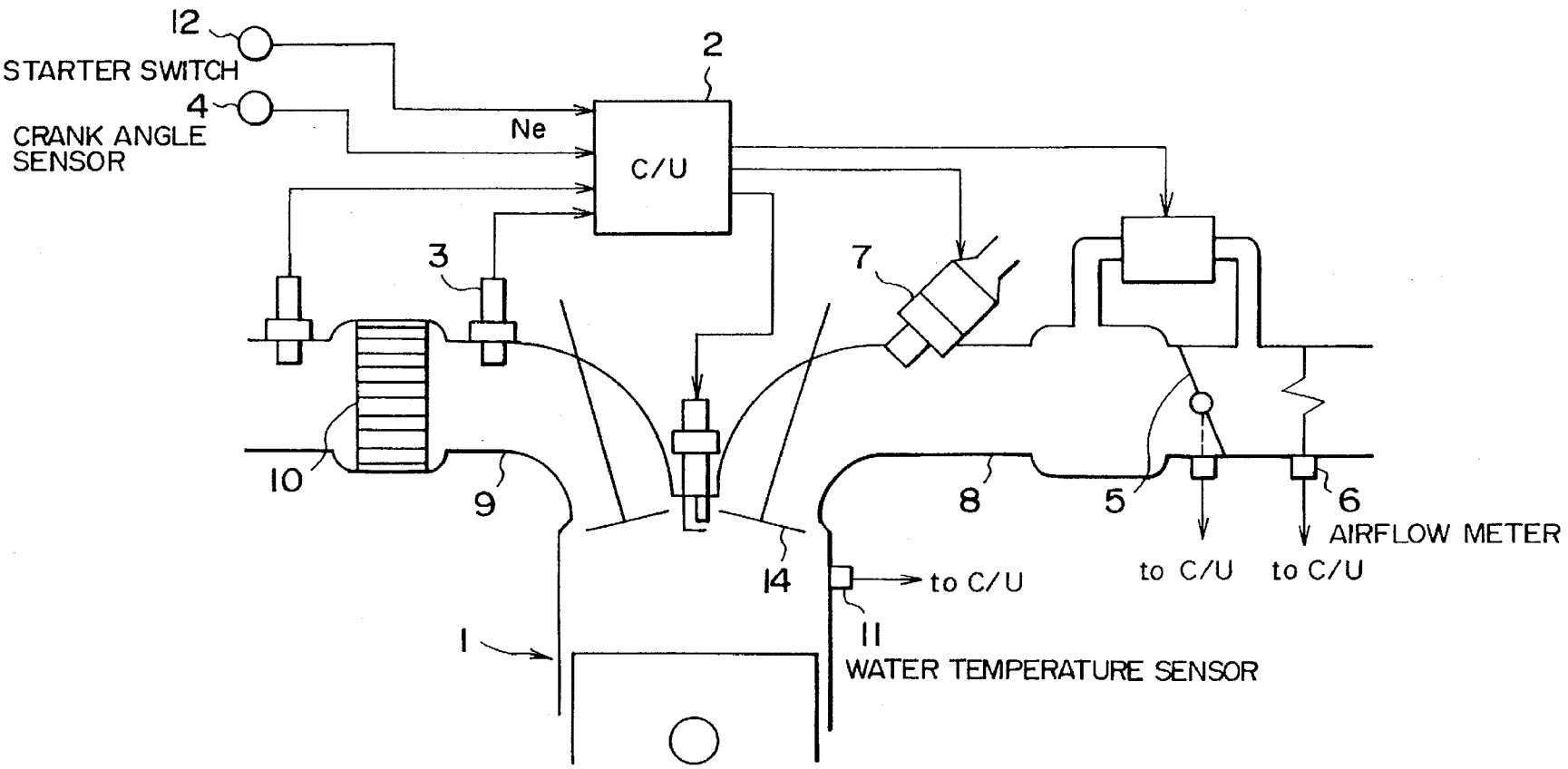
FIG. 1 is a schematic diagram of an air-fuel ratio controller according to this invention.

Referring to FIG. 1 of the drawings, intake air of an engine 1 is supplied from an air cleaner 13 via an air intake pipe 8. Fuel is injected from a fuel injection valve 7 towards an air intake valve 14 of the engine 1 based on a fuel injection signal output by a control unit 2 (abbreviated as C/U in the figure). Gas burnt in cylinders of the engine is led into a catalytic converter 10 via an exhaust pipe 9, and after noxious components (CO, HC, NOx) of the burnt gas are removed by a three-way catalyst in the catalytic converter 10, the gas is expelled to the atmosphere.

An intake air volume Qa is detected by a hot wire air flow meter 6. The air volume Qa is controlled by an intake air throttle valve 5 operating concurrently with an accelerator pedal.

An air volume signal from an air flow meter 6 is input to the control unit 2 together with signals from an air-fuel ratio sensor 3 which detects an oxygen concentration of the exhaust gas, a crank angle sensor 4 which outputs a crankshaft reference position signal (Ref signal) and a crankshaft rotation angle signal, a water temperature sensor 11 which detects a cooling water temperature Tw of a water jacket, and a starter switch 12 which detects an operation of a starter motor that cranks up the engine 1.

The control unit 2 computes a basic injection pulse width Tp from the intake air volume Qa and engine rotation speed No. During acceleration and deceleration, fuel correction is performed by adding a transient correction mount Kathos to Tp. Specifically, the transient correction mount Kathos is a correction which is applied to fuel wall flow, and it is applied not only when the vehicle is accelerating or decelerating, but also during the engine start-up when the fuel wall flow is largely varying.

The wall flow flowrate largely depends on the temperature of the part where wall flow is set up. Consequently, when all or some of the fuel is injected by the fuel injection valve 7 towards the valve 14, the temperature of the valve 14 is estimated, and the transient correction amount Kathos is computed using a predicted valve temperature Tf.

The valve temperature is effectively equal to the cooling water temperature Tw immediately after the engine start-up, and after the engine is warmed up, it levels off to a temperature higher than Tw by a constant value (e.g. approx. 80° C.). The variation during this time is a first order delay depending on a time constant determined by the intake air volume.

Figure 2:
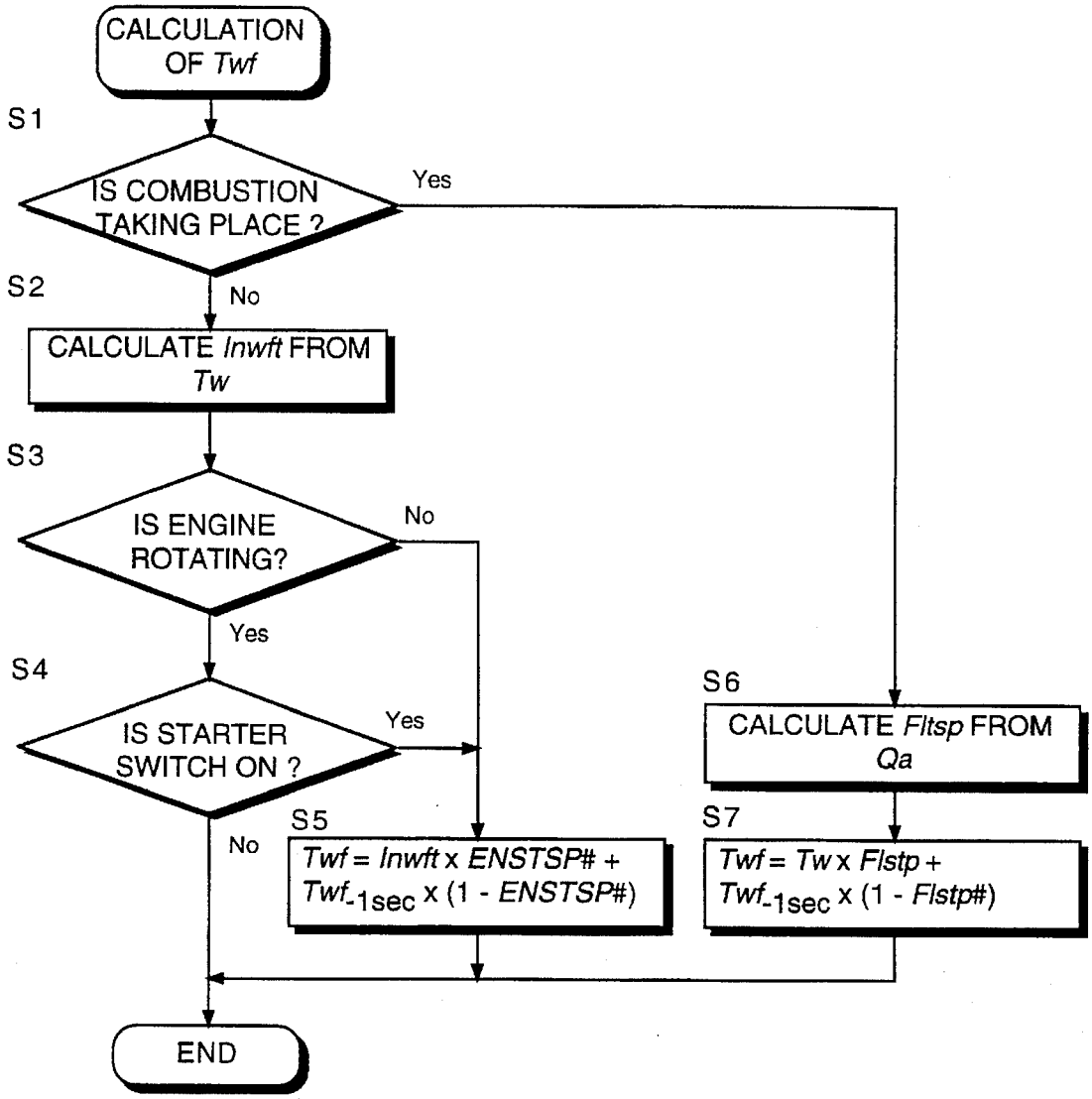
FIG. 2 is a flowchart showing a process of computing a wall flow correction temperature Twf according to this invention.

The control unit 2 computes a wall flow correction temperature according to a flowchart shown in FIG. 2. This computation process is known in the art from the aforesaid prior art Tokkai Hei 3-134237.

This computation process is executed at a fixed interval, e.g. once every 1 sec.

In a step S1, it is determined whether or not combustion is taking place in the engine 1, i.e. whether or not fuel supply has been cut, and if combustion is not taking place, the routine proceeds to a step S2.

Figure 3:
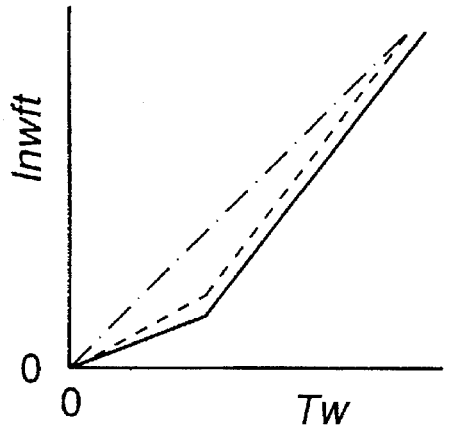
FIG. 3 is a diagram showing a characteristic of an initial value In wft of the wall flow correction temperature according to this invention.

In the step S2, an initial value In wft of the wall flow correction coefficient is found from the present cooling water temperature by referring to a map shown in FIG. 3. In this figure, the dot-and-dash line corresponds to In wft=Tw. Herein, as fuel is injected towards the valve 14, the initial value In wft is set to a value less than Tw as shown by the solid line according to the proportion of fuel injected towards the valve 14 shown on the map.

In a step S3, it is determined whether or not the engine is rotating, and in a step S4, it is determined whether or not the starter switch is ON.

When the engine is rotating and the starter switch is ON, it is determined that the vehicle is in a state immediately prior to starting. In this case and in the case that the engine is not rotating in the step S3, the routine proceeds to a step S5, and the wall flow correction temperature Twf is calculated using the wall flow correction temperature initial value In wft.

$$Twf=Inwft\cdot ENSTSP\#+Twf_{-1sec}\cdot(1-ENSTSP\#) \quad (2)$$

where, $Twf_{-1sec}$=value of Twf one second previously and

ENSTSP#=temperature change proportion prior to the engine start-up or while the engine is not operating (constant)

After calculating the wall flow correction temperature Twf by the aforesaid first order delay, the routine of FIG. 2 is terminated.

Figure 4:
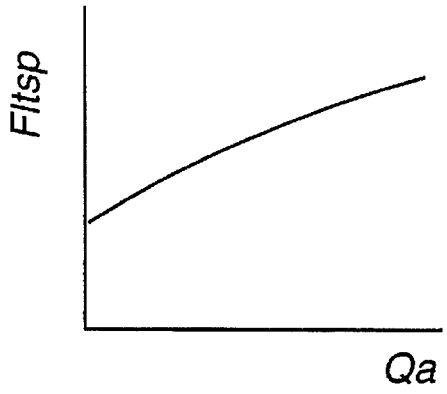
FIG. 4 is a diagram showing a characteristic of a temperature change proportion Fltsp during combustion according to this invention.

On the other hand, when fuel is being burnt in the step S1, a temperature change proportion Flstp during combustion is calculated in a step S6 from the intake air volume Qa by referring to a map shown in FIG. 4. In a step S7, the wall flow correction temperature Twf during combustion is calculated using the present cooling water temperature Tw, and the routine of FIG. 2 is terminated.

$$Twf=Tw\cdot Fltsp+Twf_{-1sec}\cdot(1-Fltsp) \quad (3)$$

In the map shown in FIG. 4, the reason why the value of Flstp is increased the higher the value of Qa, is that the heat of combustion per unit time increases for higher Qa, and heat is transmitted earlier to the fuel adhering part.

Figure 5:
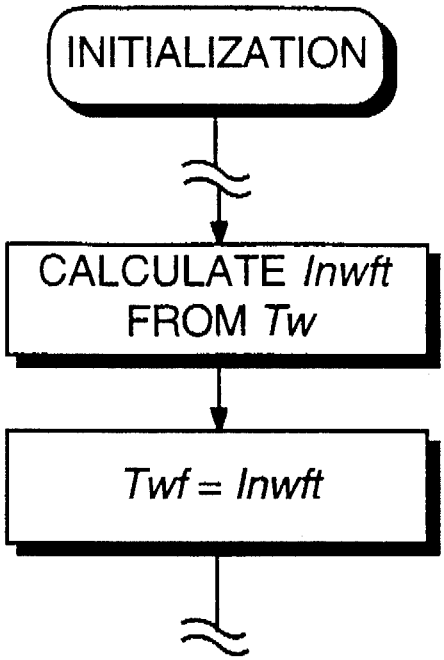
FIG. 5 is a flowchart showing an initialization process of the wall flow correction temperature according to this invention.

The routine of FIG. 5 shows a process for initializing the wall flow correction temperature performed by the control unit 2. In a step S11, the initial value Inwft of the wall flow correction temperature is calculated from the present cooling water temperature Tw, and Twf=Inwft is set in the step S12.

Figures 6A, 6B, 6C, 6D, 6E:
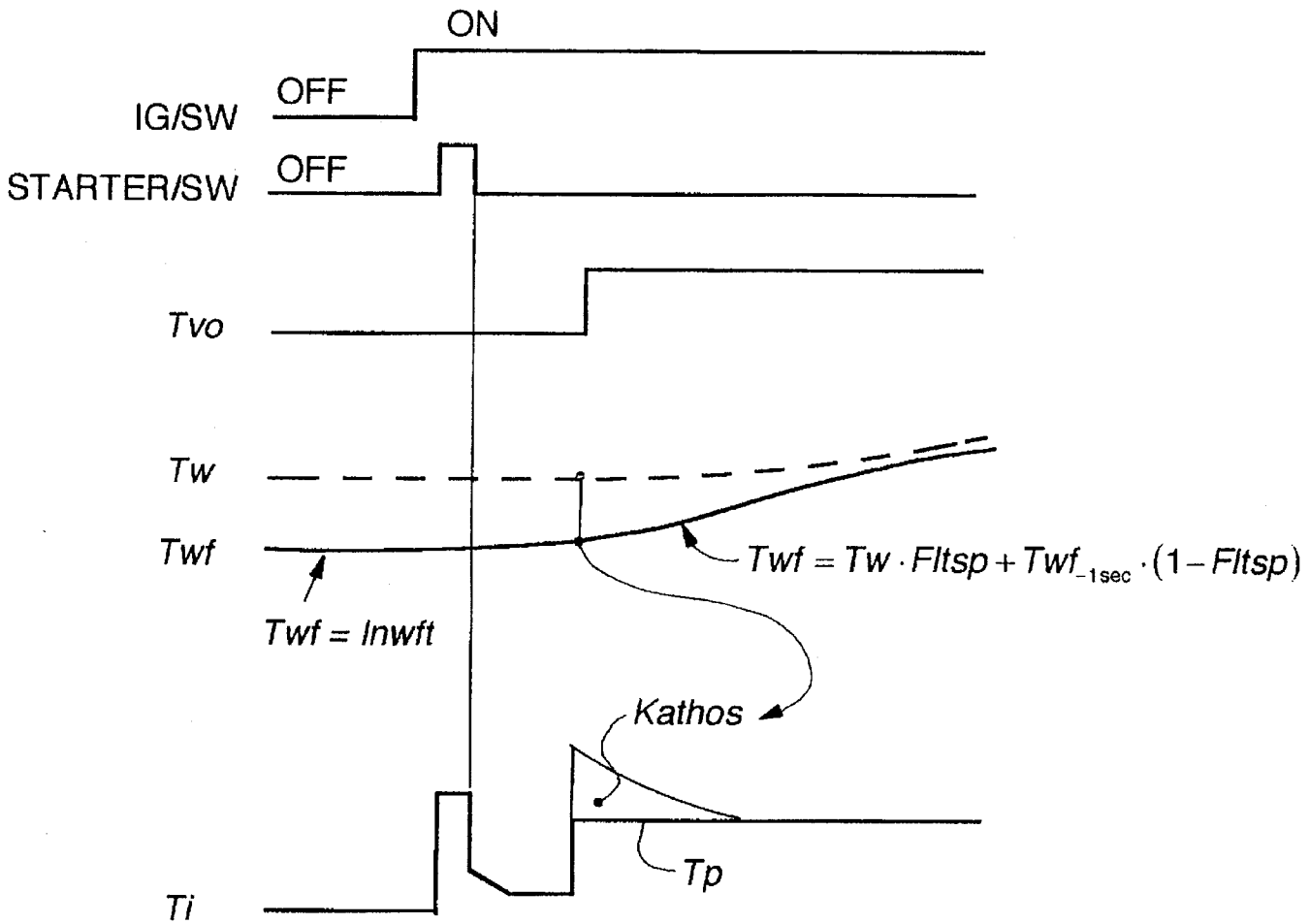
FIGS. 6A–6E are diagrams showing variations of a throttle opening TVO, cooling water temperature Tw, wall flow correction temperature Twf and fuel injection pulse width Ti immediately after an engine start-up according to this invention.
Figures 7A, 7B, 7C, 7D:
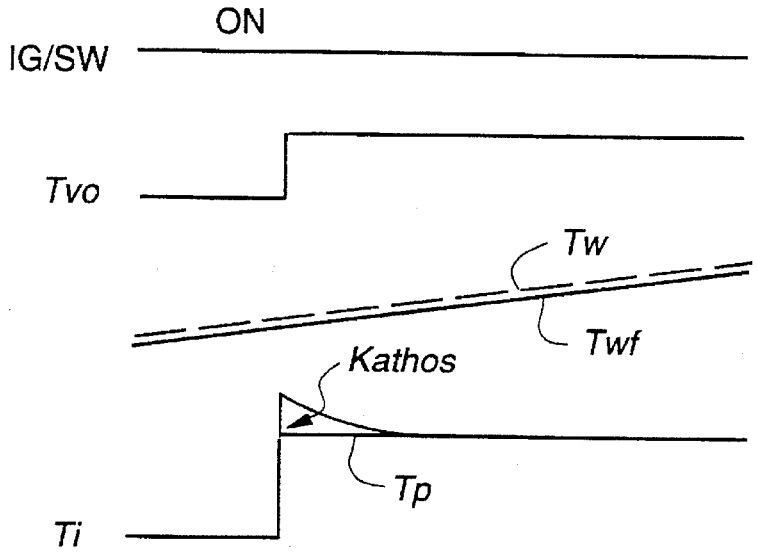
FIGS. 7A–7D are diagrams showing variations of a throttle opening TVO, cooling water temperature Tw, wall flow correction temperature Twf and fuel injection pulse width Ti during an engine warm-up according to this invention.

During warm-up, the wall flow correction temperature Twf is almost identical to the cooling water temperature Tw as shown in FIG. 7C, but after start-up, it converges from the initial value Inwft of the wall flow correction temperature to the cooling water temperature Tw as shown in FIG. 6D.

Ig/SW in FIGS. 6A and 7A denotes ignition switch, and Starter/SW in FIG. 6B denotes starter switch.

Figure 8:
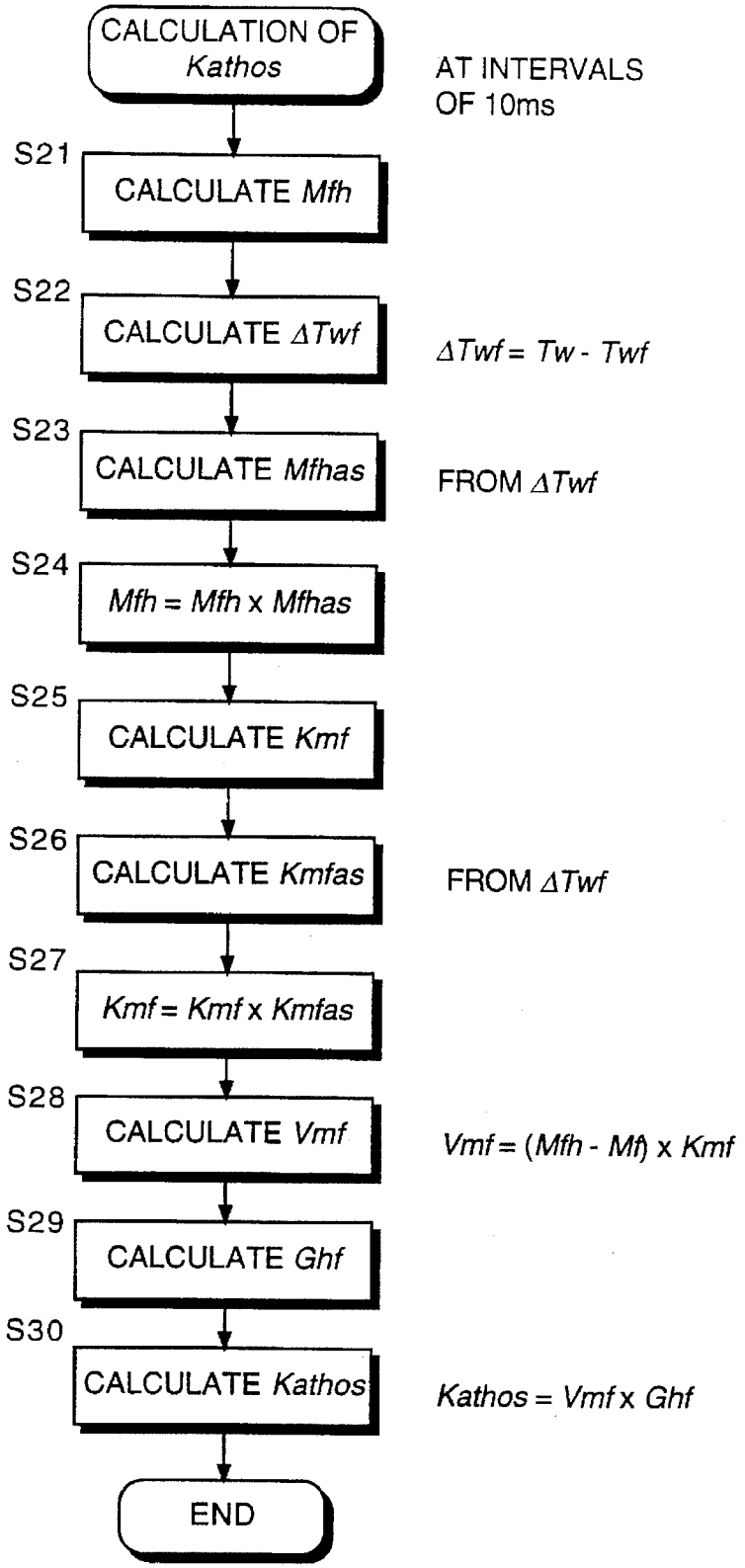
FIG. 8 is a flowchart showing a process of computing a transient correction amount Kathos according to this invention.

The flowchart of FIG. 8 shows a process whereby the transient correction Kathos is computed by the control unit 2.

This routine is executed at intervals of 10 ms. Steps S22, S23, S24, S26 and S27 will be described later.

First, in a step S21, the equilibrium adhesion amount Mfh is computed using the three parameters Ne, Tp, Twf. It is for example determined where the actual cooling water temperature Tw is situated within the temperature rages divided by the reference temperatures $Tw_0$, $Tw_1$, $Tw_2$, $Tw_3$, $Tw_4$ ($Tw_0>Tw_1>Tw_2>Tw_3>Tw_4$). When $Tw_1>Tw_1$, map values $Mfh_o$ and $Mfh_1$ corresponding to Ne and Tp are calculated from a map corresponding to the reference temperature $Tw_0$ which is the nearest temperature higher than Tw, and a map corresponding to the reference temperature $Tw_1$ which is the nearest temperature lower than $Tw_1$. Mfh is then calculated by the following linear interpolation equation using these values $Mfh_0$, $Mfh_1$, the reference temperatures $Tw_0$, $Tw_1$, and the present cooling water temperature Tw.

$$Mfh=Mfh_0+(Mfh_1-Mfh_0)\cdot\frac{Tw_0-Tw}{Tw_0-Tw_1} \quad (4)$$

The equilibrium adhesion amounts $Mfh_0$–$Mfh_4$ corresponding to the reference temperatures $Tw_0$–$Tw_4$ are first found by observation using the Ne and Tp as parameters.

The calculation of Mfh is however not limited to the above method, and it may be found also from the following relation as disclosed in the aforesaid Tokkai Hei 3-134237.

$$Vfh=Tp\cdot Mfhtvo \quad (5)$$

where, Mfhtvo=adhesion magnification

In a step S25, the extent to which the adhesion mount (estimated parameter Mf approaches the calculated value of Mfh in unit time (e.g. for one rotation of the crankshaft), is computed as a coefficient Kmf (referred to as a quantity proportion) from the product of a basic quantity proportion Kmfat and a quantity proportion rotation correction factor Kmfn. The adhesion mount Mf will be described later.

The basic quantity proportion kmfat is found from Tp and Tw by referring to a map. Kmfat is set to increase the higher the value of Tp. The quantity proportion rotation correction factor Kmfn is found from Ne by referring to a map. Kmfn is set to become larger the smaller the value of Ne.

In a step S28, the value of Kmf thus found is multiplied by the difference between Mfh and the adhesion mount Mf at the present time.

$$Vmf=(Mfh-Mf)\cdot Kmf \quad (6)$$

Mf is an estimated parameter of the adhesion mount at that time, and (Mfh–Mf) indicates the excess or insufficiency compared to the equilibrium adhesion mount. This value (Mfh−Mf) is further corrected by the quantity proportion Kmf.

After the adhesion rate Vmf is calculated, in steps S29 and S30, Vmf is further corrected by a correction factor Ghf for preventing over-lean during deceleration when light fuel is used, the transient correction mount Kathos for the basic injection pulse width Tp is found, and the routine is terminated.

Figure 9:
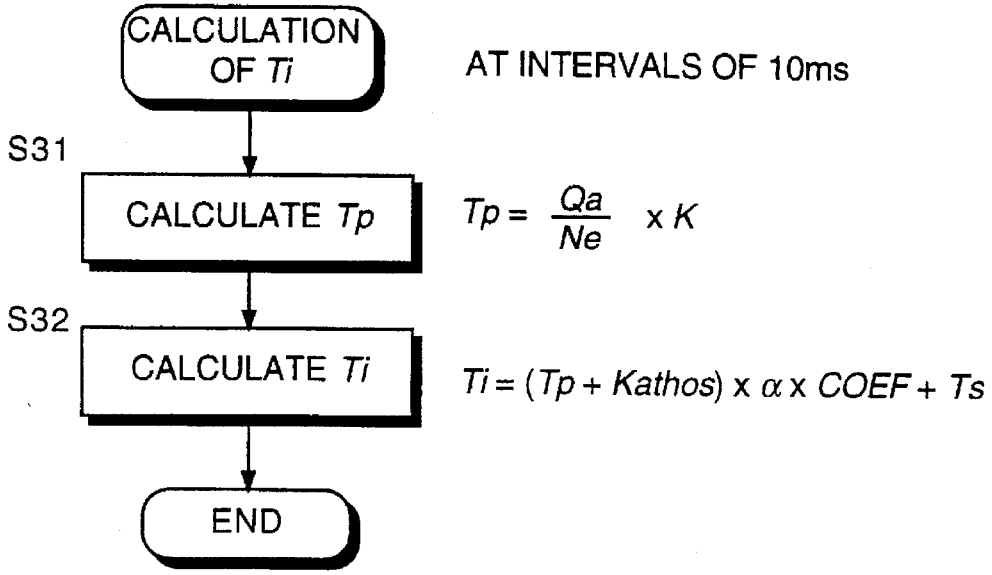
FIG. 9 is a flowchart showing a process of computing a fuel injection pulse width Ti according to this invention.

The flowchart of FIG. 9 shows a process for adding the transient correction amount Kathos in order to compute a final fuel injection pulse width Ti. This process is also executed at intervals of 10 ms by the control unit 2.

In a step S31, a basic injection pulse width $$Tp\left(=\frac{Qa}{Ne}\cdot K,\ \text{where } K \text{ is a constant}\right)$$

which for example gives the stoichiometric air-fuel ratio is calculated from the intake air volume Qa and engine speed Ne. In the step S2, a value obtained by adding the transient correction Kathos to this value, is multiplied by a feedback correction coefficient a and another correction coefficient COEF based on the output of the air-fuel ratio sensor 3, and an ineffectual pulse width Ts is added to give the final fuel injection pulse width Ti.

Figure 10:
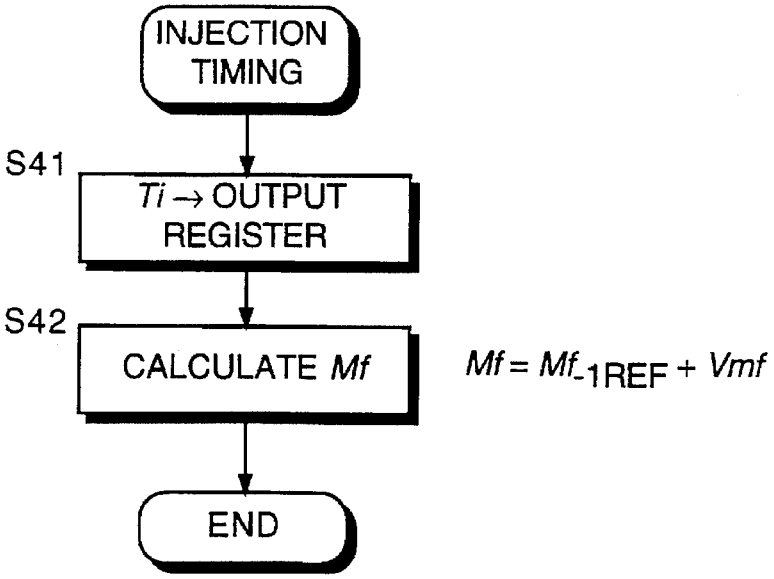
FIG. 10 is a flowchart showing a process of outputting the fuel injection pulse width Ti and computing an equilibrium adhesion amount Mfh for the next injection according to this invention.

The flowchart of FIG. 10 shows a process executed by the control unit 2 in synchronism with the injection timing (more specifically, the Ref signal). When a predetermined injection timing is reached, the fuel injection pulse width computed in FIG. 9 is transferred to an output register in a step S41, and fuel injection is then performed.

In a step S42, an adhesion amount Mf used in the next routine is determined using the adhesion rate Vmf obtained by the aforesaid equation (6).

$$Mf=Mf_{-1Ref}+Vmf \tag{7}$$

$Mf_{-1Ref}$ in Equation (7) signifies an adhesion amount when the immediately preceding injection is completed, i.e. before unit rotation. The value obtained by adding Vmf during the present injection to this value, is the adhesion mount Mf when the present injection is complete, and this adhesion amount Mf is used for calculating the Vmf on the next occasion. Whereas Mf in Equation (6) is the value immediately prior to computation of Vmf, Mf on the left-hand side of Equation (7) is the value immediately after computation of Vmf. The value of Mf in Equation (6) is therefore substituted in $Mf_{-1Ref}$ on the right-hand side of Equation (7) so as to calculate Mf on the left-hand side of Equation (7). The reason why Mf and $Mf_{-Ref}$ both appear in Equation (7) is because it is necessary to update the immediately preceding value and the present value so as to update the adhesion mount cyclically per unit rotation. Mf is updated by the above equation when fuel is injected and the initial value of Mf is predetermined according to the cooling water temperature Tw at the engine start-up.

Figure 13A:
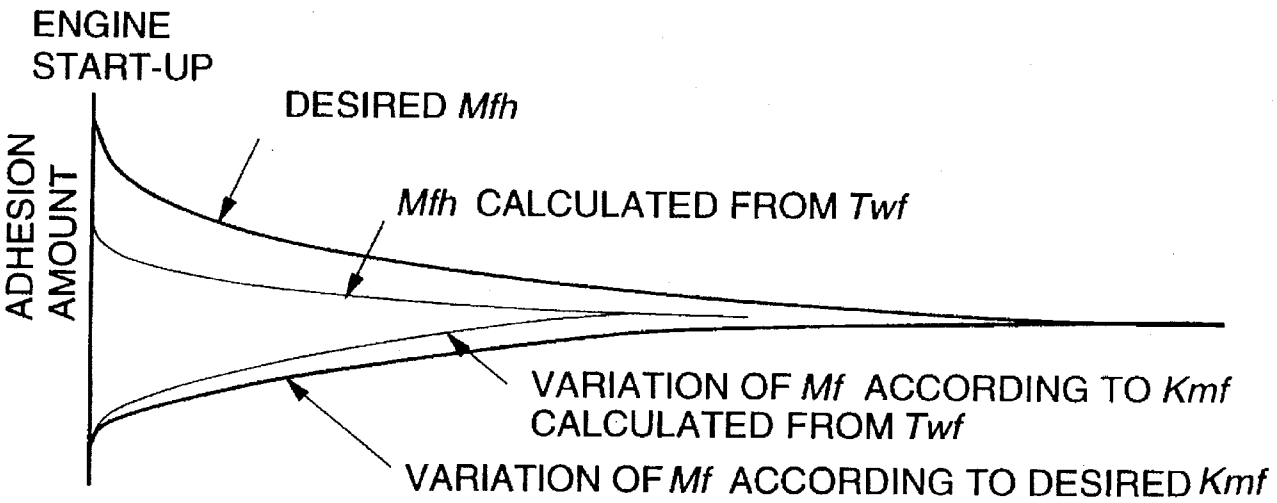
FIGS. 13A and 13B are diagrams showing variations of an adhesion amount Mf, the adhesion amount Mfh and the temperature Twf immediately after the engine start-up according to this invention.
Figure 13B:
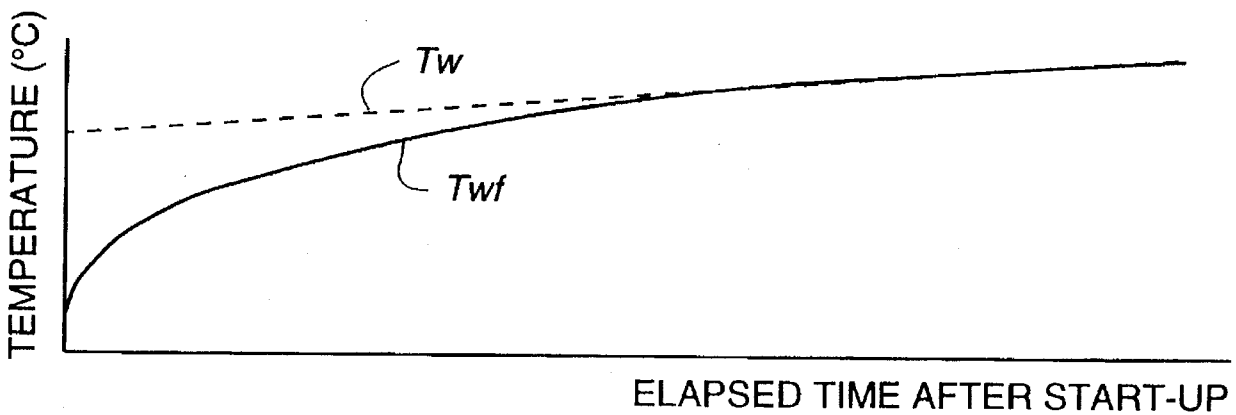

The data required to calculate Mfh and Kmf , i.e. the map values $Mfh_0$–$Mfh_4$ and the basic quantity proportion Kmfat, are based on the cooling water temperature in the equilibrium temperature state, hence $Mfh_0$ –$Mfh_4$ and Kmfat in the equilibrium state do not necessarily correspond to actual values. This means that the desired accuracy is not obtained merely by using the wall flow correction temperature Twf instead of the cooling water temperature. In other words, Mfh is less than the desired value when it is calculated from Twf in FIG. 13B, and the variation of Mf with Kmf found from Twf is more rapid than the desired variation, as shown in FIG. 13A.

Figures 16A, 16B, 16C:
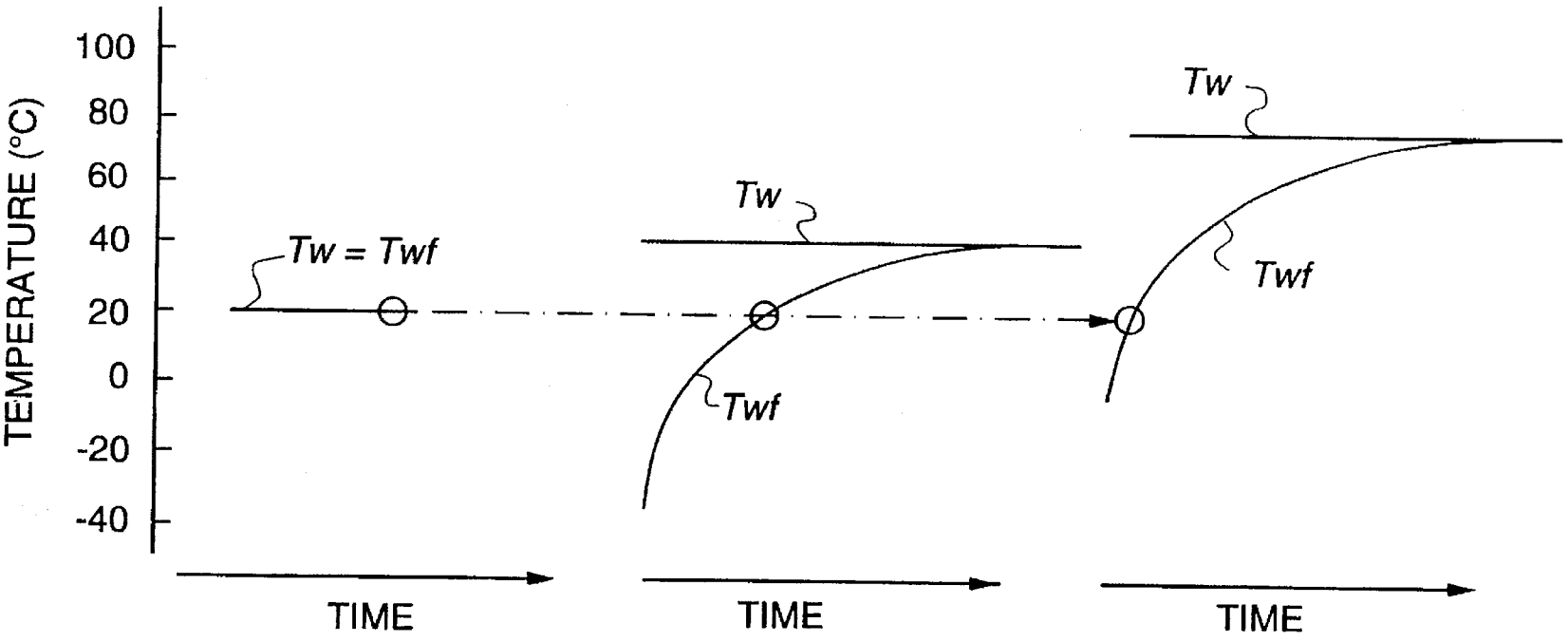
FIGS. 16A–16C are diagrams describing an effect of differences of the cooling water temperature Tw on wall flow correction temperature Twf.

Further, consider the cases for a 20° C. equilibrium temperature state, start-up from a cooling water temperature Tw=40° C., and start-up from a cooling water temperature Tw=80° C., as shown in FIGS. 16A–16C. It will be assumed for the sake of convenience that the cooling water temperature Tw is invariant. In the case of FIG. 16A, Twf is constant at 20° C., so the data for Mfh, Kmf in the temperature equilibrium state may be used without modification. In the cases of FIGS. 16B and 16C, however, a temperature non-equilibrium correction must be applied to the data for temperature equilibrium. Also, a lager correction is required for the case of FIG. 16C, when a difference ΔTwf between Tw and Twf is larger.

According to this invention, suitable data for cooling water temperature in the temperature equilibrium state is searched based on the detected value Tw of cooling water temperature, Mfh and Kmf are computed, and a correction factor for temperature non-equilibrium is computed according to the temperature difference ΔTwf between Tw and Twf.

Mfh and Kmf are then corrected by this correction factor for temperature non-equilibrium. More specifically, the steps S22, S23, S24, S26 and S27 in the routine of FIG. 8 correspond to this process.

Figure 11:
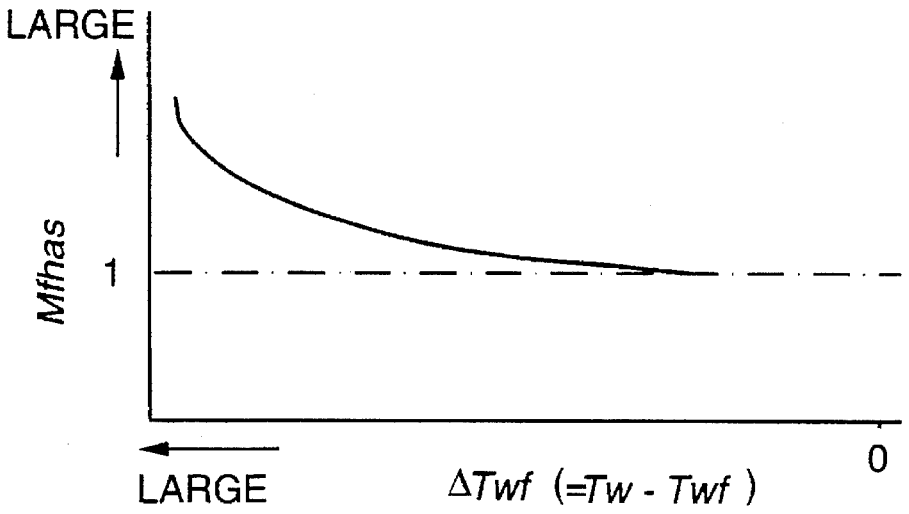
FIG. 11 is a diagram showing a characteristic of a correction factor Mfhas related to an equilibrium adhesion amount Mfh during temperature non-equilibrium according to this invention.

First, in the step S22 of FIG. 8, the temperature difference ΔTwf between Tw and Twf is computed. In the step S23, a map in FIG. 11 is searched from this temperature difference ΔTwf, and a correction factor Mfhas for temperature non-equilibrium corresponding to Mfh, is found. In a step S24, Mfh is corrected by multiplying Mfh calculated in the step S1 by this correction factor Mfhas.

Figure 12:
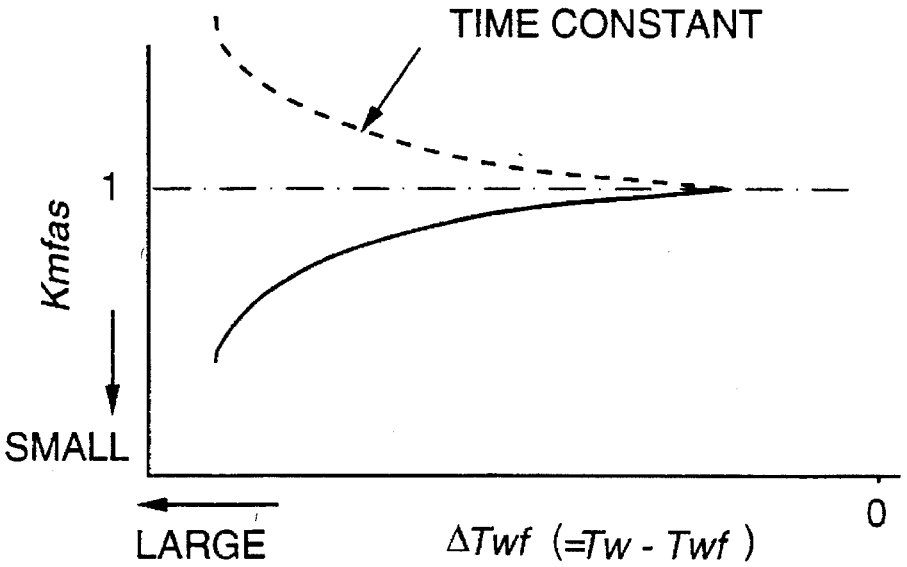
FIG. 12 is a diagram showing a characteristic of a correction factor Kmfas related to a quantity proportion Kmf during temperature non-equilibrium according to this invention.

Likewise, a map shown in FIG. 12 is searched from the temperature difference ΔTwf, and a correction factor Kmfas for temperature non-equilibrium corresponding to Kmf is found. In the step S27, Kmf is corrected by multiplying Kmf found in the step S25, by the correction factor Kmfas.

Herein, Mfhas is a value which increases the larger the temperature difference ΔTwf, as shown in FIG. 11. Kmfas is a value which decreases the larger the temperature difference ΔTwf, as shown in FIG. 12. The characteristics of these correction factors Mfhas, Kmfas, may be deduced from FIGS. 13A and 13B. The difference between Mfh calculated from Twf and the desired value Mfh, and the difference between Kmf calculated from Twf and the desired value Kmf, are both largest immediately after start-up, and they decrease the smaller the temperature difference ΔTwf between Tw and Twf. The desired values are values required by actual transient conditions, and may be found from experiment or analysis.

The aforesaid characteristics correspond to the fact the temperature difference ΔTwf is largest immediately after start-up, and that it gradually decreases with elapsed time after start-up. It may be conjectured that the non-equilibrium state of the retake air valve temperature is more significant for a larger temperature difference ΔTwf.

Figure 14A:
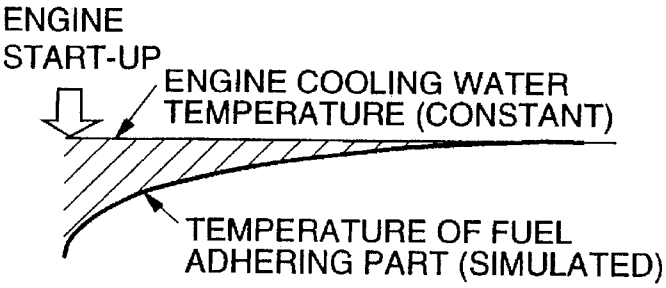
FIGS. 14A–14D are diagrams showing variations of a fuel adhering part temperature, the adhesion amount, the air-fuel ratio and an adhesion rate immediately after the engine start-up according to this invention.
Figure 14B:
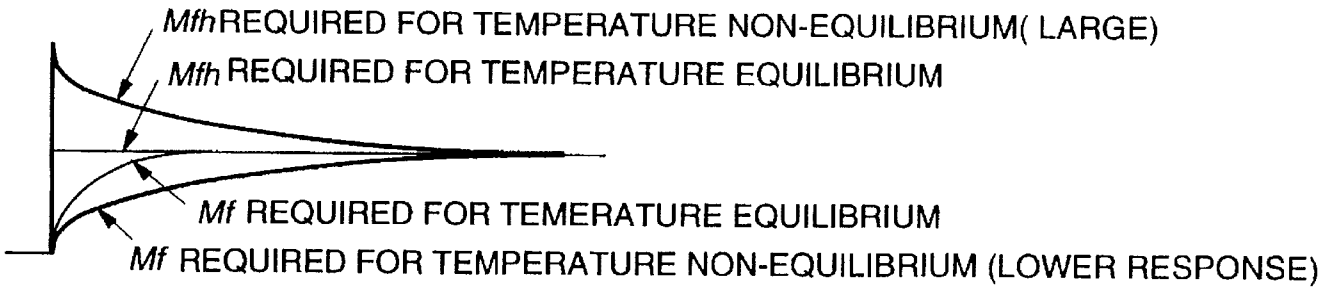
Figure 14C:
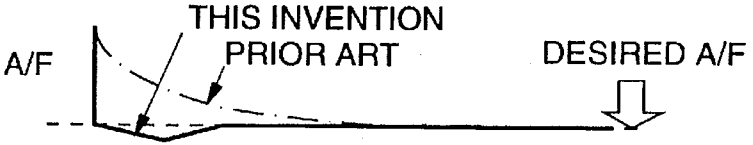
Figure 14D:
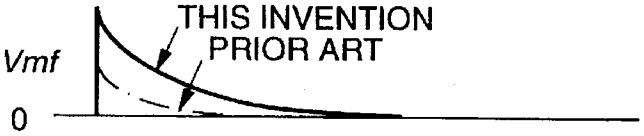

Now, referring to FIGS. 14A–14D, consider the case where Mfh required for the non-equilibrium state is larger than Mfh required for the equilibrium state. In FIGS. 14C and 14D the dotted lines correspond to the aforesaid prior art, and the thick lines correspond to this invention.

According to this invention, Mfh and Kmf obtained using Tw are corrected by the correction factors Mfhas and Kmfas for temperature non-equilibrium. In other words, Mfh is corrected by Mfhas to a larger value than for temperature equilibrium, and Kmf is corrected by Kmfas so that the response of Mf is smaller than the response required for temperature equilibrium. As a result, Mfh and Mf coincide with the values required for temperature non-equilibrium, Vmf approaches the value required for temperature non-equilibrium, and any tendency of the air-fuel ratio toward lean immediately after start-up is prevented.

Next, a second embodiment of this invention will be described.

In the aforesaid controller, the correction factors Mfhas and Kmfas for temperature non-equilibrium are found based on ΔTwf=Tw−Twf. According to the second embodiment, Tw, Twf or the water temperature at the engine start-up are further used along with ΔTwf as parameters to specify Mfhas and Kmfas. By setting the correction factors even more finely In this way, the correction of temperature non-equilibrium Is made more reliable.

According to a third embodiment of this Invention, in addition to ΔTwf=Tw−Twf, engine load is assigned as a parameter of Mfhas and Kmfas.

In general, the correction factor Mfh increases the higher the engine load. This is because the wall flow tends to vaporize more easily as the intake pipe pressure approaches atmospheric pressure from a higher pressure. It is therefore desirable that the correction factors Mfhas and Kmfas for temperature non-equilibrium vary according to the engine load. The temperature non-equilibrium correction factors Mfhas and Kmfas are then obtained with good precision even when the engine load is different in the temperature non-equilibrium state.

Three parameters may also be used to find Mfhas and Kmfas, i.e. the temperature difference between Tw and Twf, any one of Tw, Twf or the cooling water temperature, and the engine load.

Figure 15:
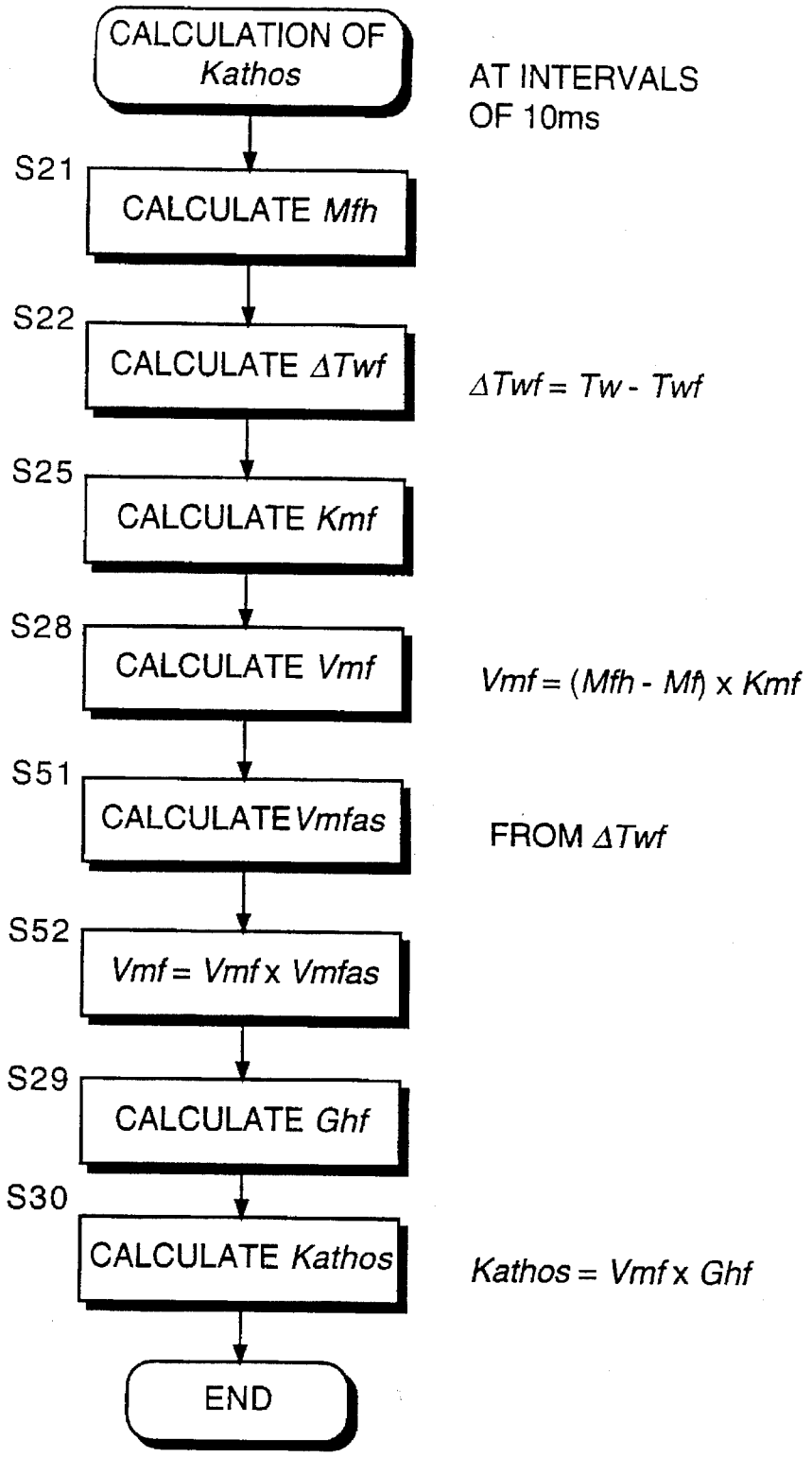
FIG. 15 is a flowchart showing a process of computing the transient correction amount Kathos according to a fourth embodiment of this invention.

The flowchart of FIG. 15 shows a fourth embodiment of this invention. This chart corresponds to the chart of the first embodiment of FIG. 8.

According to the preceding three embodiments, both Mfh and Kmf were corrected for the temperature non-equilibrium state. Although this would provide a reliable correction, however, it is not easy to obtain precise values for the two correction factors Mfhas and Kmfas immediately after engine start-up.

According to the fourth embodiment, Vmf (or Kathos) during temperature equilibrium are corrected for temperature non-equilibrium. More specifically, in steps S51 and S52 of FIG. 15, a correction factor Vmf as for temperature non-equilibrium corresponding to Vmf is found from the temperature difference ΔTwf between Tw and Twf by referring to a predetermined map. Vmf In the step S8 is multiplied by this correction factor Vmfas, and a new value of after correction is found.

According to the fourth embodiment, the correcting elements comprise only one constant, so the number of correcting steps is less than in the case of the preceding three embodiments. The inventors found experimentally that this did not lead to any loss of precision in the air-fuel ratio immediately after start-up.

As in the case of the aforesaid first to third embodiments, the parameters used to find Vmfas may be the temperature difference ΔTwf between Tw and Twf (corresponding to the first embodiment), the temperature difference ΔTwf together with Tw, Twf or water temperature at the engine start-up (corresponding to the second embodiment), or the temperature difference ΔTwf together with the engine load (corresponding to the third embodiment).

In an "L-jetronic type multi-point injection system", the engine load which serves as a parameter to find Mfhas, Kmfas and Vmfas may be expressed by the basic injection pulse width Tp and intake air volume Qa, but in a "D-jetronic type multi-point injection system", the intake pipe negative pressure may be used. In an "α-N type multi-point injection system", an α-N flowrate $QH_O$ may be used as the engine load.

According to the aforesaid embodiments, the wall flow correction temperature Twf was used as the air Intake valve estimated temperature Tf, however it will be understood that the intake valve estimated temperature Tf of Equation (1) may itself be used instead.

The embodiments of this invention in which an exclusive property or privilege is claimed are defined as follows:

1. A fuel injection controller for an engine in which fuel is injected towards a fuel adhering part from a fuel injector, comprising:

means for computing a basic fuel injection a mount, means for detecting an engine cooling water temperature, means for computing an equilibrium mount of said injected fuel adhering to said fuel adhering part based on a cooling water temperature in an equilibrium state, means for computing a quantity proportion based on said cooling water temperature in said equilibrium state, means for predicting an amount of injected fuel that will adhere to said fuel adhering part at a present time, means for estimating a temperature of said fuel adhering part, means for computing a temperature difference between said cooling water temperature and the temperature of said fuel adhering part, means for computing an adhesion rate based on said equilibrium adhesion amount, said predicted adhesion mount, said quantity proportion and said temperature difference, means for correcting said basic injection mount and computing a fuel injection mount based on said adhesion rate, and means for supplying said fuel injection mount to said fuel injector.

2. A fuel injection controller as defined in claim 1, wherein said adhesion rate computing means comprises means for correcting said equilibrium adhesion mount according to said temperature difference, and means for computing an adhesion rate by multiplying a difference between a corrected equilibrium adhesion amount and said predicted adhesion amount, by said quantity proportion.

3. A fuel injection controller as defined in claim 2, wherein said equilibrium adhesion amount correcting means further corrects said equilibrium adhesion amount according to any one of said cooling water temperature, said fuel adhering part estimated temperature and said cooling water temperature during engine start-up.

4. A fuel injection controller as defined in claim 2, wherein said equilibrium adhesion amount correcting means further corrects said equilibrium adhesion amount according to an engine load.

5. A fuel injection controller as defined in claim 1, wherein said adhesion rate computing means comprises means for correcting said quantity proportion according to said temperature difference, and means for calculating an adhesion rate by multiplying a difference between said equilibrium adhesion amount and said predicted adhesion amount, by a corrected quantity proportion.

6. A fuel injection controller as defined in claim 5, wherein said quantity proportion correcting means further corrects said quantity proportion according to any one of said cooling water temperature, said fuel adhering part estimated temperature and said cooling water temperature during engine start-up.

7. A fuel injection controller as defined in claim 5, wherein said quantity proportion correcting means further corrects said quantity proportion according to an engine load.

8. A fuel injection controller as defined in claim 1, wherein said adhesion rate computing means comprises means for calculating an adhesion rate by multiplying a difference between said equilibrium adhesion amount and said predicted adhesion amount by said quantity proportion, and means for correcting said adhesion rate according to said temperature difference.

9. A fuel injection controller as defined in claim 8, wherein said adhesion rate correcting means further corrects said quantity proportion according to any one of said cooling water temperature, said fuel adhering part estimated temperature and said cooling water temperature during engine start-up.

10. A fuel injection controller as defined in claim 8, wherein said adhesion rate correcting means further corrects said adhesion rate according to an engine load.

11. A fuel injection controller as defined in claim 1, wherein said adhesion amount predicting means updates said predicted adhesion amount on every fuel injection by adding said adhesion rate to said predicted adhesion amount.

* * * * *